United States Patent [19]

Lorenz et al.

[11] 4,115,202

[45] Sep. 19, 1978

[54] APPARATUS FOR PRODUCING NON-ABRASIVE COKE FORMS FROM BROWN-COAL BRIQUETS

[75] Inventors: Kurt Lorenz, Hattingen; Horst Dungs, Herne; Peter Speich, Cologne; Roman Kurtz, Frechen, all of Fed. Rep. of Germany

[73] Assignees: Firma Carl Still; Rheinische Braunkohlenwerke Aktiengesellschaft, both of Fed. Rep. of Germany

[21] Appl. No.: 833,645

[22] Filed: Sep. 15, 1977

Related U.S. Application Data

[60] Continuation of Ser. No. 706,542, Jul. 19, 1976, abandoned, which is a division of Ser. No. 660,153, Feb. 23, 1976, abandoned.

[30] Foreign Application Priority Data

Feb. 22, 1975 [DE] Fed. Rep. of Germany ..... 2507735
Aug. 21, 1975 [DE] Fed. Rep. of Germany ..... 2537191

[51] Int. Cl.[2] ..... C10B 1/04; C10B 3/02; C10B 21/02

[52] U.S. Cl. ..... 202/99; 202/108; 202/109; 202/121; 201/15; 201/29; 201/34; 201/37

[58] Field of Search ..... 201/15, 27, 29, 34, 201/35, 37, 39, 43, 44; 202/99, 108, 109, 121, 127, 114

[56] References Cited

U.S. PATENT DOCUMENTS

| | | | |
|---|---|---|---|
| 1,563,271 | 11/1925 | Fogh | 201/29 |
| 1,901,169 | 3/1933 | Karrick | 202/99 |
| 1,907,569 | 5/1933 | Parr et al. | 202/99 |
| 2,131,702 | 9/1938 | Berry | 201/15 |
| 2,448,223 | 8/1948 | Lantz | 201/27 |
| 3,172,823 | 3/1965 | John et al. | 202/26 |
| 3,177,128 | 4/1965 | Vartanian | 202/108 |
| 3,316,155 | 4/1967 | Holowaty et al. | 201/27 |
| 3,705,086 | 12/1972 | Schmalfedd et al. | 201/34 |
| 4,007,093 | 2/1977 | Doilov et al. | 201/34 |
| 4,050,990 | 9/1977 | Lorenz | 201/27 |

*Primary Examiner*—Morris O. Wolk
*Assistant Examiner*—Bradley Garris
*Attorney, Agent, or Firm*—McGlew and Tuttle

[57] ABSTRACT

The coke forms are produced in four stages, each constituted by a respective oven chamber, and in which the briquets are, respectively, preheated, dehydrated or dried, carbonized and cooled. Hot gas circuits are provided, in which the hot gas is composed substantially of burnt lean gas of the carbonization, and, for each stage, the hot gases are recirculated in a separate respective circuit. In the preheating, dehydrating and carbonization stages, the hot gases are heated and produced, or supplemented, in a respective separate combustion chamber with the recirculating hot gas in the carbonization stage being supplemented with cooled lean gas from this stage. The recirculating hot gases are dedusted separately in a dust settling chamber in which their flow velocity is reduced to approximately 0.2 to 2.0 m/sec, with the dust being collected. Steam may be added to the recirculating hot gas of the preheating stage, drying stage, or both, and the pressure in the hot gas circuits is maintained at a level slightly higher than atmospheric pressure. The oven chambers are arranged as a vertical oven block plant and the oven chambers are interconnected with each other by transition zones which are conically narrowed to approximately one half of the cross section of the chamber and then widened up to the full cross section. The hot gas inlets are provided in the transition zones at the lower ends of the oven chambers, and the hot gas outlets are provided in the transition zones at the upper ends of the chambers. The dust settling chambers are provided immediately adjacent the hot gas outlets, and the carbonization chamber is surrounded by its combustion chamber to form an operating unit.

4 Claims, 6 Drawing Figures

FIG. 1

APPARATUS FOR PRODUCING NON-ABRASIVE COKE FORMS FROM BROWN-COAL BRIQUETS

CROSS-REFERENCE TO RELATED APPLICATION

This is a continuation of application Ser. No. 706,542, filed July 19, 1976, and now abandoned, which was a division of application Ser. No. 660,153, filed Feb. 23, 1976.

FIELD AND BACKGROUND OF THE INVENTION

The present invention relates to a device for producing non-abrasive coke forms from brown-coal briquets, according to which the briquets are preheated, dehydrated, carbonized and subsequently cooled, with the entire operation being effected in at least three stages and with the use of hot gas circuits in which the hot gas is composed substantially of the burnt lean gas of the carbonization or low temperature carbonization process.

Such devices are well known in the art. Frequently the individual stages are united or merge into one another. While a complete separation of the individual stages is technically very difficult to achieve, in view of a better utilization of the circulating hot gases, a complete separation of the hot gas circuits would be desirable. The technology also seeks to increase the mechanical resistance of the produced coke forms. Particular difficulties result from the fact that, in their circulation, the hot gases carry along large quantities of coal dust originating in the abrasion of the briquets and, at the same time, contain oil and tar components. This entails particular problems of condensation which, up to date, have not been solved in the art in a satisfactory manner. In this respect again, an increased mechanical resistance of the briquets to be coked is desirable.

The condensation and scrubbing of oil and tar components out from the dust-laden gases leads to the necessity of removing the washing liquids, which are loaded with coal dust, from the scrubbing circuit, since their viscosity becomes excessive and then can no longer be pumped. The further processing of such mixtures is expensive wherefore a better dust separation from the circulating gases would represent a technological progress, all the more as the dust entrained by the circulating gases causes clogging in almost all parts of the equipment, and which can be cleared only by troublesome manual work.

In known devices, temperatures of 110° to 135° C for the preheating, 230° to 330° C for the drying and 550° to 650° C for the coking are used.

It is also known to use the lean gas, produced during the carbonization, for preheating and drying and as the drying gas for preheating and subsequently, to evacuate the gases into the free atmosphere. It is also known to separate the individual stages by means of mechanical members, such as lids. However, this measure frequently entails disturbances in the plant.

SUMMARY OF THE INVENTION

The present invention is directed to a device permitting a satisfactory separation of dust from the hot gases in circulation so that the condensation is not disturbed and clogging is eliminated, and, at the same time, ensuring a thorough carbonization resulting in non-abrasive coke forms stable in shape. The invention is further directed to a device permitting a satisfactory separation of the hot gas circuits and operable in a regular and economical manner without using mechanical separating members, such as lids.

In accordance with the invention, a device of the kind mentioned in the beginning is provided in which, in each stage, the hot gases are recirculated in a separate circuit. This measure alone already makes it possible to optimize quite substantially the temperature-time curve of the coking process, which is determinative for the mechanical resistance of the coke forms.

In this connection, it has been found advantageous to carry out the process in separate stages in which the brown-coal briquets are preheated, dehydrated, or dried, carbonized and cooled, respectively.

A further advantage has been found in that the hot gases recirculating in the preheating, dehydrating and carbonization stages are each produced, supplemented and heated in a separate combustion chamber.

The adjustment of the temperature in the carbonization stage becomes simple if cooled lean gas from the carbonization stage is added to the recirculating hot gas.

In accordance with a particular development of the invention, the hot gas of each of the circuits is dedusted separately, immediately after the gas has left the stage and before it has been substantially cooled down. In the dust settling chambers, the gas has a velocity of 0.2 to 2.0 m/sec, depending on what degree of dust separation is desired.

In a preferred variant of the inventive device, (a) the preheating is effected up to a temperature of 120° C, while using 1.5 to 2.5 $Nm^3/h$ of hot gas per 1 kg of brown-coal briquets; (b) the dehydration is effected at 210° to 250° C, while using 5 to 6 $Nm^3/h$ of hot gas per 1 kg of brown-coal briquets; (c) the carbonization is effected at 800° to 900° C, while using 1.5 to 2.5 $Nm^3/h$ of hot gas per 1 kg of brown-coal briquets, the hot gases being heated in the combustion chamber to a temperature of 1000° to 1400° C and lean gas, coming from the carbonization stage and cooled down to 25° to 35° C, is admixed thereto.

For obtaining coke forms having a satisfactory mechanical resistance, the control of the preheating and drying of the brown-coal briquets or forms is of great importance. The control of the ratio of the fresh gas to the recirculating gas in the different hot gas circuits is a means for adjusting any water vapor content in the preheating and drying stages and, thereby, for adjusting any preheating and drying velocity as well as any temperature gradient from the surface to the core of the forms.

It is true that, in most cases, the water vapor concentration in the hot gas circuits of the preheating and drying stages is satisfactory already due to the use of only recycle gas for adjusting a low temperature gradient in the forms. However, from time to time, the addition of steam may also prove advantageous.

During the preheating, the brown-coal forms expand and, during the drying phase, they start shrinking, due to the loss of water. To prevent crack formation during this process, the transition from the expansion to the shrinkage must be extremely smooth, wherefore the temperature gradient in the forms during this heating phase is to be kept as low as possible.

Experience has shown that this requirement is met more satisfactorily if additional steam is supplied into the hot gas circuit of the preheating stage and/or the drying stage. Thereby, due to the high water vapor concentration in the gas circuits, the escape of water vapor from the surface of the forms is retarded and a gentle treatment of the briquets is obtained. Thus all means are now available for adjusting any degree of humidity of the preheating and drying gases and, consequently, for controlling the preheating and drying velocity.

Advantageously, the process is conducted at a pressure which is slightly higher than the atmospheric pressure. In this manner, the intrusion of air oxygen is prevented.

An oven particularly suitable for carrying out the invention comprises four oven chambers arranged one above the other, for preheating, dehydrating, carbonization and cooling, respectively, which are partly lined with a refractory material and which, in the transition zone from one chamber to the next one, are conically narrowed down to approximately one half of the cross section of the chamber and again enlarged up to the full cross section of the chamber. The hot gas inlets of the chambers are provided in the conically diverging lower ends and the outlets in the upper ends of the chambers, and a gas combustion chamber for producing, supplementing and heating the recirculating hot gases is provided in the hot gas circuits of the preheating, dehydrating and carbonization chambers.

In order to facilitate the temperature adjustment, a supply line for cooled lean gas of the carbonization stage is connected to the outlet of the combustion chamber of the carbonization chamber.

A simple construction of the oven plant is obtained by designing the carbonization chamber as surrounded by its combustion chamber, the combustion chamber thus being accommodated therein, and forming therewith an operating unit.

It is also advisable to provide the dust settling chambers of each circuit immediately adjacent the hot gas outlet of each oven chamber and so that they fit to the double-conical transition zones connecting each oven chamber to the next one.

A plurality of such oven installations may be assembled to a united oven block plant which, in this case, comprises common combustion chambers for the respective oven chambers and a common cooling installation for all ovens.

An object of the invention is to provide an improved device for producing non-abrasive coke forms from brown-coal briquets.

A further object of the invention is to provide such a device in which the coke forms are produced in several stages with the use of hot gas circuits with each stage having a respective separate hot gas recirculating circuit.

For an understanding of the principles of the invention, reference is made to the following description of a typical embodiment thereof as illustrated in the accompanying drawings.

DESCRIPTION OF THE PREFERRED EMBODIMENT

Figure 1:
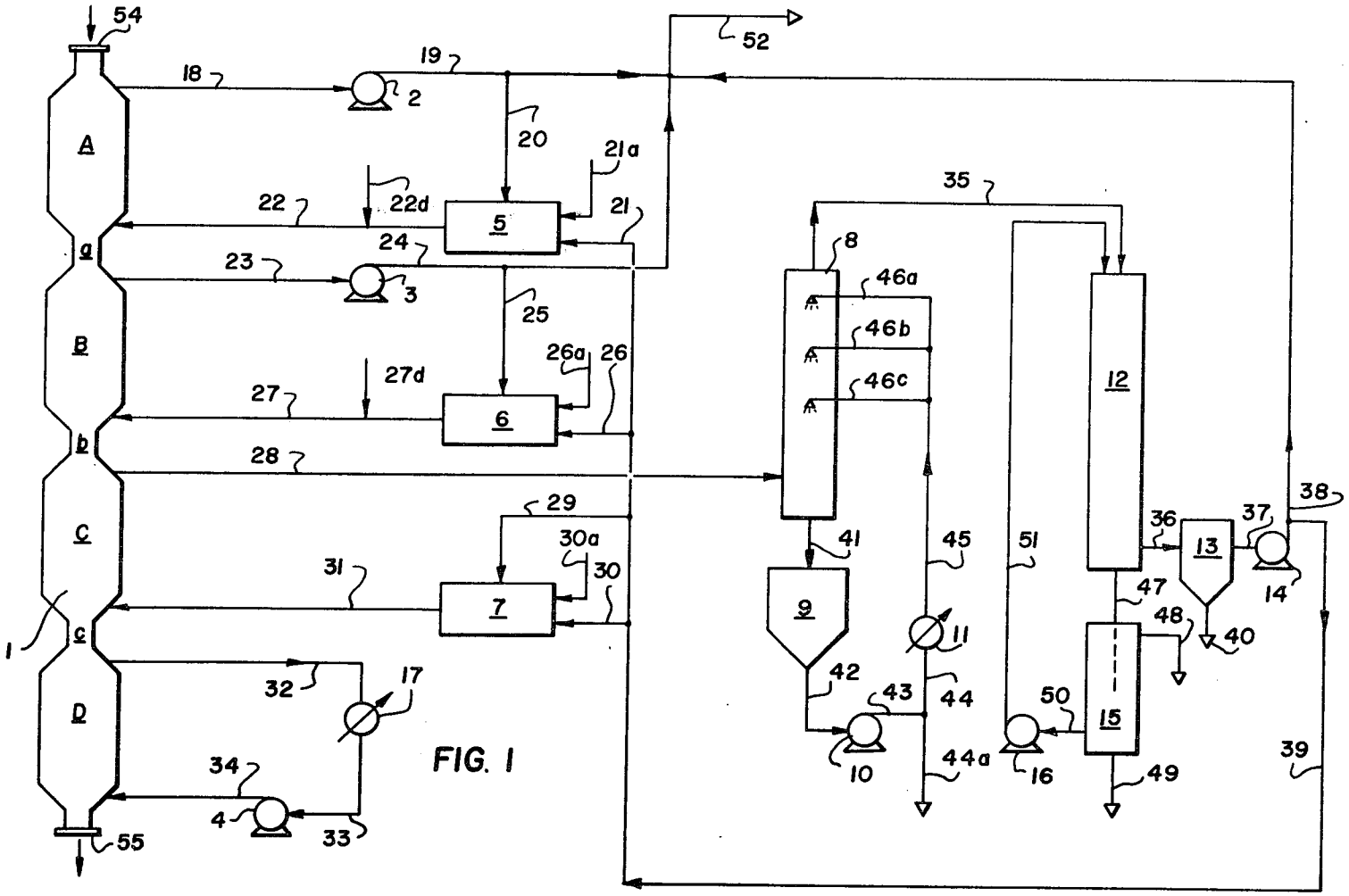
FIG. 1 is a diagrammatical illustration of the process of the invention.
Figure 2:
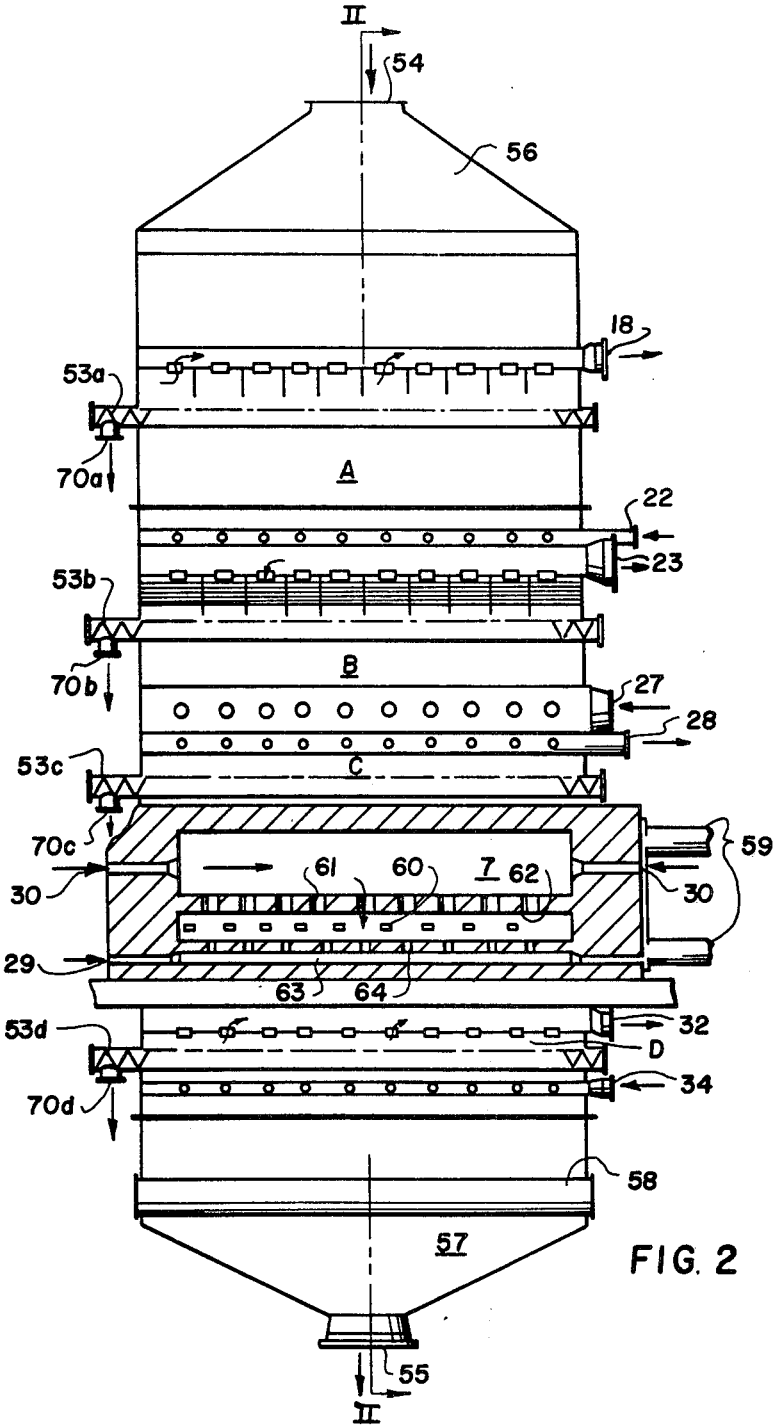
FIG. 2 is partly a lateral elevational view and partly a sectional view of the oven, the sectional view being taken along the line III—III of FIG. 3.
Figure 3:
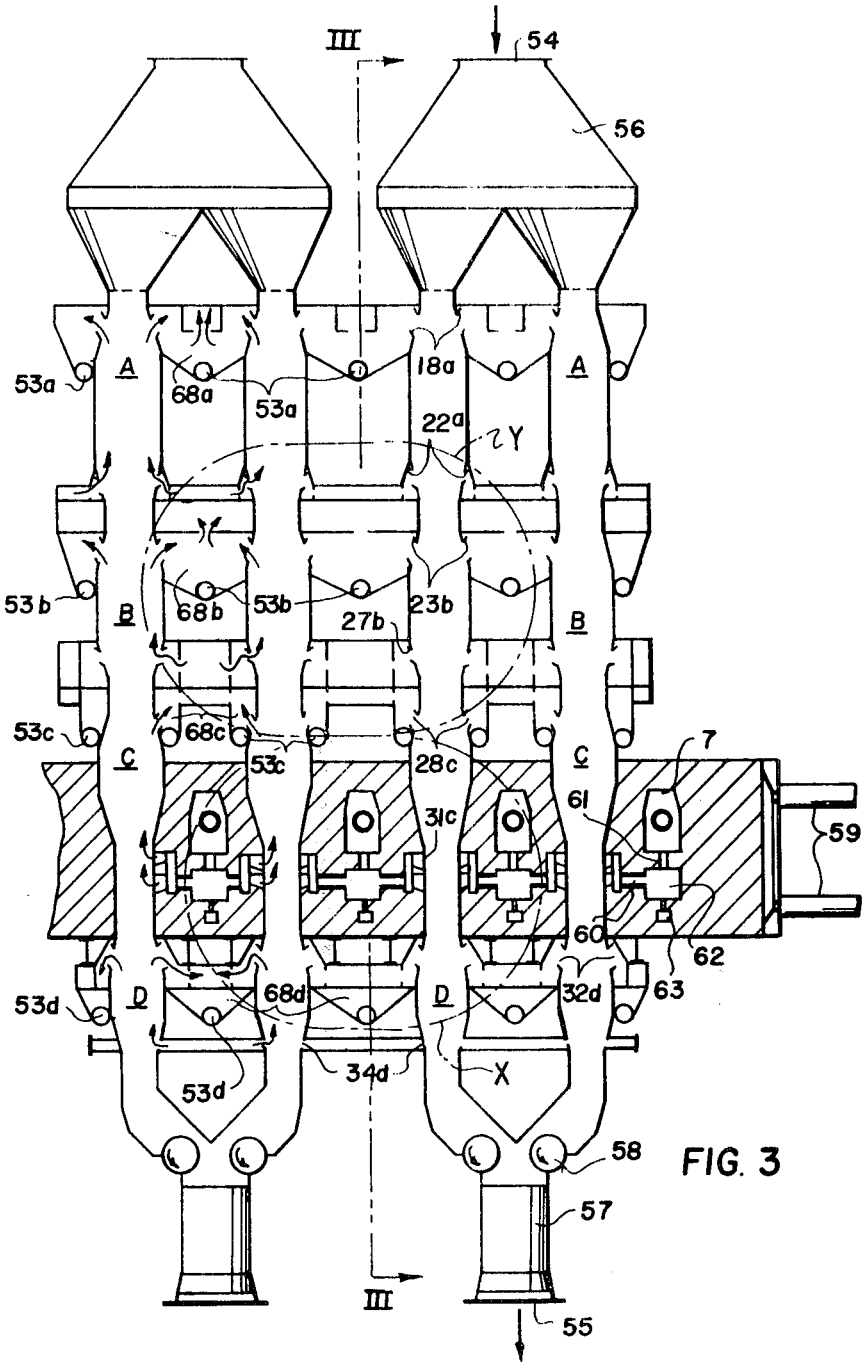
FIG. 3 is a sectional view taken along the line II—II of FIG. 2.

The drawings show a vertical oven block plant 1 comprising a charge lock 54 (not shown in detail), a receiver 56 (FIG. 2), oven chambers A for preheating, B for dehydrating or drying, C for carbonization, and D for cooling, a discharge bin 57, a discharge cylinder 58 and a discharge lock 55 (not shown in detail). The oven chambers are provided with respective gas inlet slots *22a, 27b, 31c* and *34d* which communicate with respective supply lines 22, 27, 31 and 34. The respective gas outlets *18a, 23b, 28c* and *32d* communicate, through respective dust settling chambers *68a, 68b, 68c* and *68d*, with respective outlet lines 18, 23, 28 and 32. The dust collected in dust settling chambers *68a* to *68d* is discharged by means of respective screw conveyors *53a, 53b, 53c* and *53d*, through respective locks *70a, 70b, 70c* and *70d*.

The lean gas evacuated through line 28 is directed to a cooling scrubber 8 operating with a tar circuit. To this end, lines 41, 42, 43, 44, 45 and *46a, 46b, 46c*, as well as a tar tank 9, a circulating pump 10 and a cooler 11, are provided. Through line *44a*, the tar in excess is locked out. The cooled and washed gas is directed, through a line 35, to a secondary cooler 12 where the gas is cooled indirectly. The condensed oil components and the ammoniacal water are supplied, through line 47, to a tar separating tank 15. The aqueous phase is discharged through line 49 and the oily phase through line 48. For rinsing the cooler 12, lines 50, 51 and circulating pump 16 are provided.

The scrubbed and cooled lean gas flows through line 36 into an electrostatic filter 13 having a discharge opening 40 and in which the secondary dedusting takes place, and therefrom, through the line 37, to a lean gas blower 14 by which it is forced into lines 38 and 39. Lean gas in excess is evacuated through line 52. The lean gas needed in the plant is distributed, through respective lines 39, 21, 26 and 30, to combustion chambers 5, 6 and 7. The combustion chambers are supplied with combustion air through respective lines *21a, 26a* and *30a*. Oven chambers A to C are supplied with their recirculating gases through respective lines 22, 27 and 31. Connections *22d* and *27d* are provided for supplying steam into the circuits which are directed through oven chambers A and B. The circuits are also provided with circulating blowers 2, for oven chamber A, and 3, for oven chamber B. No separate blower is necessary for the circuit of oven chamber C. This circuit is supplied directly, through lines 29 and 39 and by means of blower 14, with cooled lean gas from the scrubber circuit. Cooling chamber D is supplied with flue gases from oven chamber C, recirculating in an inert gas circuit. This circuit also comprises lines 32, 33 and 34 as well as a cooler 17 and a blower 4. Oven chambers A to D of the oven plant 1 are connected to each other by the narrowed connecting zones *a* to *c*.

The gas circuits of oven chambers A and B communicate, through outlet lines 19 and 24, with exhaust line 52, and they are controlled so that the preheating takes place within the temperature range of 110° to 135° C, the dehydration between 210° and 230° C, the carbonization between 800° and 900° C and the cooling between 30° and 70° C.

While the narrowed zones *a* to *c* between the oven chambers do not effect any hermetical separation of the gas circuits relative to each other, the separation thereby obtained is satisfactory.

Efficient removal of dust from the circulating hot gases is important, and this is effected by a variation of the gas velocities. Thus, inlet slots 22*a*, 27*b*, 31*c*, and 34*d*, through which the circulating hot gases from lines 22, 27, 31 and 34 pass into oven chambers A to D, have a large passage cross section and are dimensioned so that the gas velocities therethrough are about 1.0 m/sec. The outlet slots 18*a*, 23*b*, 28*c* and 32*d*, through which the gases escape and pass into dust settling chambers 68*a* to 68*d*, are dimensioned similarly. Nozzles 221 and 271, on the contrary, through which the gases, for example, from lines 22 and 27, pass to connecting boxes 222 and 272, have a small passage cross section. Here, the gas velocities are approximately 15 m/sec. The same applies to nozzles 231 through which the gases pass from dust settling chamber 68*b* to line 23.

Figure 5:
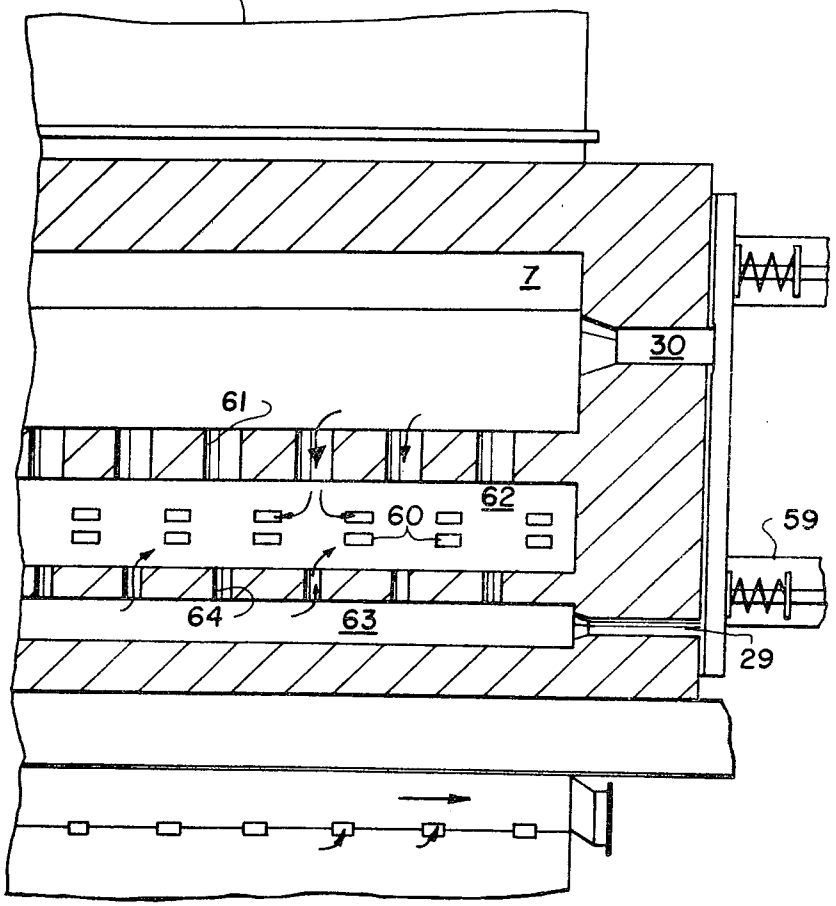
FIG. 5 is a sectional view taken along the line IV—IV of FIG. 4.
Figure 4:
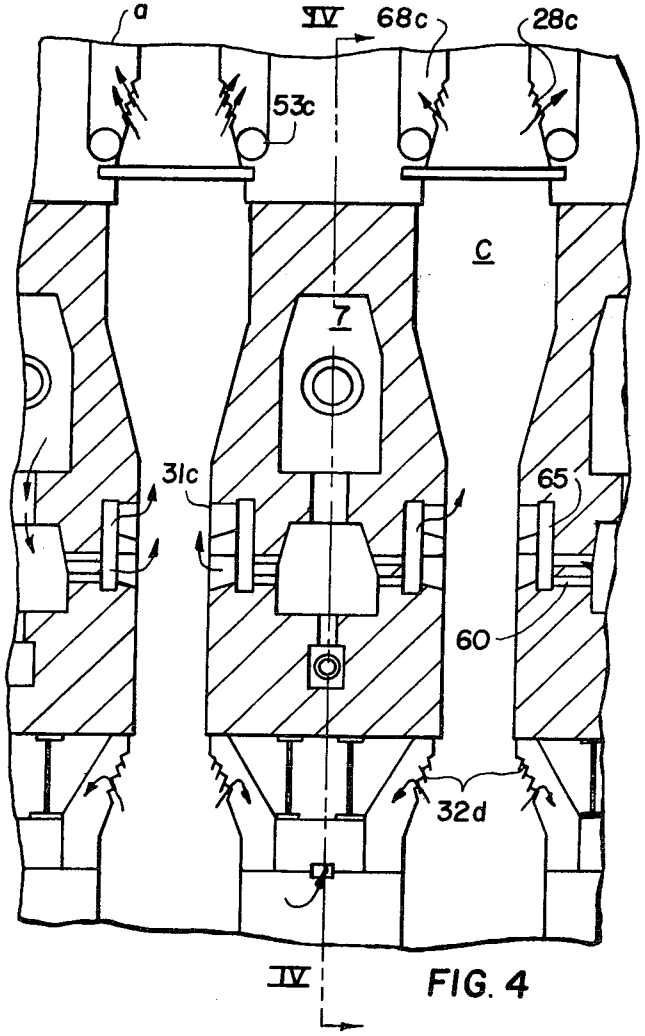
FIG. 4 is the enlarged detail X of FIG. 3.
Figure 6:
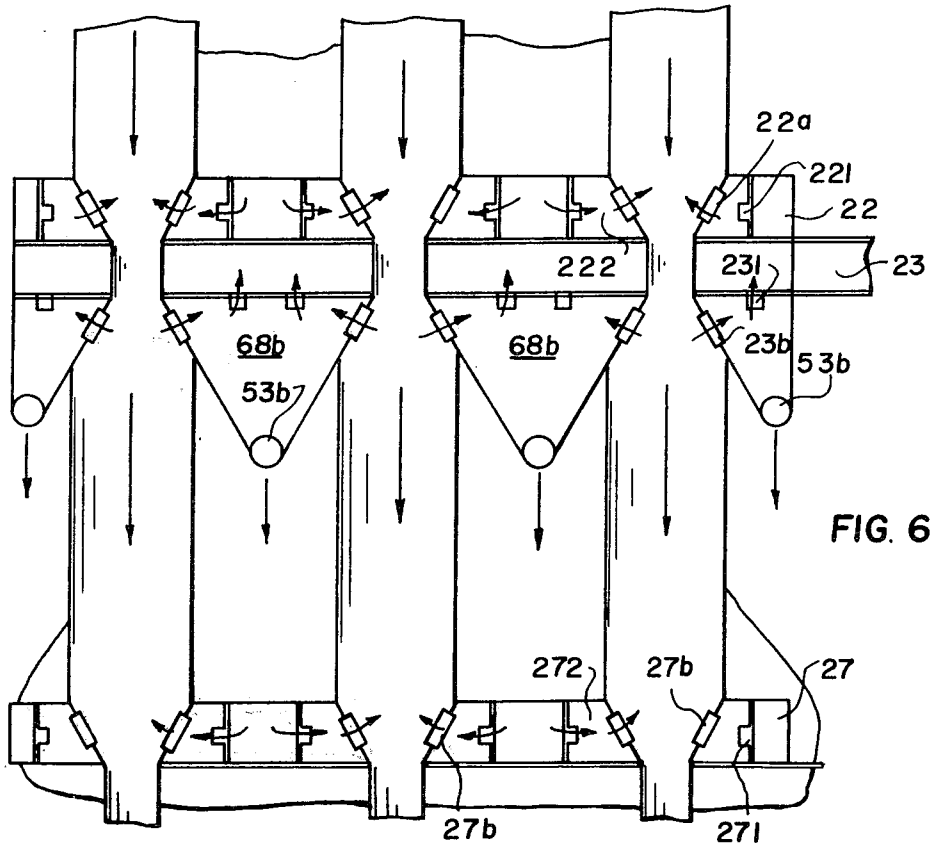
FIG. 6 is the enlarged detail Y of FIG. 3.

In the zone of carbonization chambers C and their combustion chamber 7, passage slots 61 are provided leading from combustion chamber 7 to a mixing channel 62. Cooled lean gas passes through line 29 into channel 63 and through slots 64 into mixing channel 62 (FIG. 5). The mixed gas flows through distributing slots 60 into a collecting channel 65 (FIG. 4) and therefrom, through gas inlets 31*c*, into oven chambler C. Slots 60 also have a small passage cross section causing a gas velocity of approximately 15 m/sec while, in inlets 31*c*, having a large passage cross section, the gas velocities are approximately 1.0 m/sec again. Oven chambers C with combustion chamber 7 and the equipment thereof are anchored at 59.

While a specific embodiment of the invention has been shown and described in detail to illustrate the application of the principles of the invention, it will be understood that the invention may be embodied otherwise without departing from such principles.

The embodiment of the invention in which an exclusive property or privilege is claimed is defined as follows:

1. In apparatus for producing non-abrasive coke forms from brown coal briquettes, of the type in which the brown coal briquettes are preheated, dehydrated or dried, carbonized and subsequently cooled in an oven in at least three respective stages, and including gas recirculating circuits for recirculating gas consisting essentially of combustion lean gas obtained from carbonization of the brown coal briquettes, with the gas in the recirculating circuits for the carbonization being heated and the gas in the recirculating circuits for the cooling being cooled, the improvement wherein said oven comprises four oven chambers arranged in superposed aligned relation and including a preheating chamber, a dehydrating chamber, a carbonization chamber and a cooling chamber; each chamber having conically converging upper and lower ends; means interconnecting the conically converging ends of adjacent chambers, said interconnecting means and said conically converging ends defining transition zones between said oven chambers, the cross-sectional area of each of said transition zones decreasing from one chamber toward the next subjacent chamber to approximately one-half the cross-sectional area of the superjacent chamber and then increasing to the full cross-sectional area of the subjacent oven chamber; respective gas inlets for each oven chamber provided around the entire periphery of the conically converging lower end thereof; respective gas outlets for each oven chamber provided around the entire periphery of the conically converging upper end thereof; respective means connecting the gas outlet of each chamber to the gas inlet thereof to provide, for each chamber, a primary gas recirculating circuit respective to only that chamber and separate from the primary gas recirculating circuits respective to the other chambers; respective combustion chambers, supplied with such combustion lean gas and with air, connected in the primary gas recirculating circuits of said pre-heating and dehydrating chambers for separately heating the respective gases recirculating therein; and respective dust settling receptacles provided immediately adjacent the gas outlets of said oven chambers and surrounding the transition zones interconnecting said oven chambers; said dust settling receptacles effecting separate dedusting of the recirculating gases of the respective oven chambers while reducing the flow velocity of the respective recirculating gases to substantially 0.2 to 2.0 m/sec.

2. In apparatus for producing non-abrasive coke forms, an improved oven as claimed in claim 1, including means connected to the hot gas outlet of said carbonization chamber for cooling lean gases of the carbonization stage; and a supply conduit connected between said cooling means and to the primary gas recirculating circuit of said carbonization chamber whereby cooled lean gas from the carbonization stage is added to the recirculating gas thereof prior to recycling the recirculated gas into the carbonization chamber.

3. In apparatus for producing non-abrasive coke forms, an oven as claimed in claim 1, including a steam supply connection to the primary hot gas recirculation line connected to the hot gas inlet of said preheating chamber.

4. In apparatus for producing non-abrasive coke forms, an oven as claimed in claim 1, including a steam supply connection to the primary hot gas recirculation line connected to the hot gas inlet of said dehydrating chamber.

* * * * *